United States Patent [19]

Ou

[11] 4,008,504

[45] Feb. 22, 1977

[54] PORTABLE SHOE SHINE APPARATUS

[76] Inventor: Jan-Chou Ou, 33-7 Lane 46, Kuan Fu South Road, Taipei, China /Taiwan

[22] Filed: Mar. 9, 1976

[21] Appl. No.: 665,226

[52] U.S. Cl. ..... 15/258; 15/107; 15/114; 15/184; 401/27

[51] Int. Cl.[2] ..... A47L 23/05; A47L 23/08; A47L 23/28

[58] Field of Search ..... 15/107, 114, 184, 258; 401/24–27

[56] References Cited

UNITED STATES PATENTS

| | | | |
|---|---|---|---|
| 845,928 | 3/1907 | Brooks | 15/107 |
| 898,998 | 9/1908 | Stubenrauch | 15/107 |
| 2,972,768 | 2/1961 | Petion | 401/27 |

FOREIGN PATENTS OR APPLICATIONS

| | | | |
|---|---|---|---|
| 1,657,291 | 2/1971 | Germany | 15/184 |

*Primary Examiner*—Daniel Blum
*Attorney, Agent, or Firm*—Burns, Doane, Swecker & Mathis

[57] ABSTRACT

A portable and compact shoe shine apparatus with a replaceable roller set which contains a brush, a shoe cream spreader and a buffer, and a casing for housing the said roller set and the shoe cream container. Functions of removing the dirt and clean the shoe surface, applying shoe cream, and buffing the shoe surface to create a luster thereon can be performed and achieved with one unit with easy and simple operation.

5 Claims, 23 Drawing Figures

PORTABLE SHOE SHINE APPARATUS

FIELD OF INVENTION

This invention relates generally to a device for cleaning and shining the shoes, and more particularly to such a portable device which can perform dusting, spreading shoe cream and polishing shoe surface through using of the same unit.

BACKGROUND OF INVENTION

The conventional approach of cleaning and shining the shoes are generally to use a brush to remove the dust and dirt from the shoes surface, then to spread the shoe cream on the shoe surface by using the brush or sponge spreader, and finally to buff the shoes to luster by using some sort of soft substance such as a piece of cloth. Throughout the process, a number of different kinds of appliances and materials have to be used. It is not a neat and clean chore for people to do. It is particularly bothersome to bring those things around during traveling which become very popular to many people nowadays.

In order to save time and effort on shoe cleaning and polishing, some kind of devices have been produced and marketed. However they are far from perfect as yet. On the simple handy devices, mostly they can only apply shoe cream and/or provide a means to polish the shoe, but cannot perform all the functions required through one unit. Different and separate appliances and materials are still needed to clean and polish one pair of shoes. On the more complicate devices, such as some with electric motor as driving power, they may perform more functions, but they become more bulky and more expensive, and sometime even not so flexible and convenient as the conventional manual method.

Therefore to use different and separate appliances at different stages to clean and polish the shoes is still the most widely used method, even though it is a chore not very neat and clean.

SUMMARY OF THE INVENTION

The shoe shine apparatus of this invention includes, within a single casing, all the substances needed to clean and to shine the shoes. And the said substances have been pre-arranged to make them ready to perform different kinds of functions at different time during the shoe cleaning and polishing process, thus substantial time and efforts can be saved as compare to conventional shoe shining approach.

A feature of this invention is the provision of a replaceable roller set. The roller set provides, at its peripheral surface, a brush, a shoe cream spreader, and a buffer. The brush is to remove the dirt from the shoe surface. The shoe cream spreader is to apply the shoe cream on the shoe surface. The buffer is to polish the shoe surface to create a luster thereon.

Another feature of this invention is the provision of roller set positioning device. By means of turning the positioning knob, which can be pushed to mesh with the roller set, either one of the brush, the shoe cream spreader, or the buffer can be placed at the front end position of the casing to perform the required function respectively.

The said positioning knob also provides a locking arm, which when being set at the locking position, can hold the positioning knob stationary and prevent it from rotating, and consequently hold the roller set from rotating when there is force applying to the roller set during the shoe shine operations.

A further feature of this invention is the provision of a roller set snap locking device which is hinged on the side wall of the casing. The said snap locking device provides a hooked arm at the front end to retain the roller set within the casing. By depressing the rear end of the said snap locking device, the roller set can be released from the casing when changing of the roller set is required.

A still another feature of this invention is the provision of the replaceable brush, shoe cream spreader and buffer from the roller set. A meshing lug is provided underneath the base of the brush, and can be retained on the roller set or be released from it. The same arrangement also apply to the shoe cream spreader and buffer. By means of such provision, the worn out brush, or shoe cream spreader, or buffer can be removed and replaced individually without imperiling the function of the roller set.

One more feature of this invention is the provision of roller set cartridge which consists of a receiving casing and an inserting casing. The said roller set cartridge serves as the container of a spare roller set. The receiving casing can house the roller set which has been released from the shoe shine apparatus. While the said inserting casing which can hold a roller set on its arms can be used to insert the roller set into the shoe shine apparatus. Such arrangement will keep the user's hands from direct contact with the brush, or shoe cream spreader, or buffer. Therefore when it is necessary to change or replace the roller set for polishing different color of shoes, the user's hands can be free from taint or dirt.

DETAILED DESCRIPTION OF PREFERRED EMBODIMENT

General Description

Figure 1:
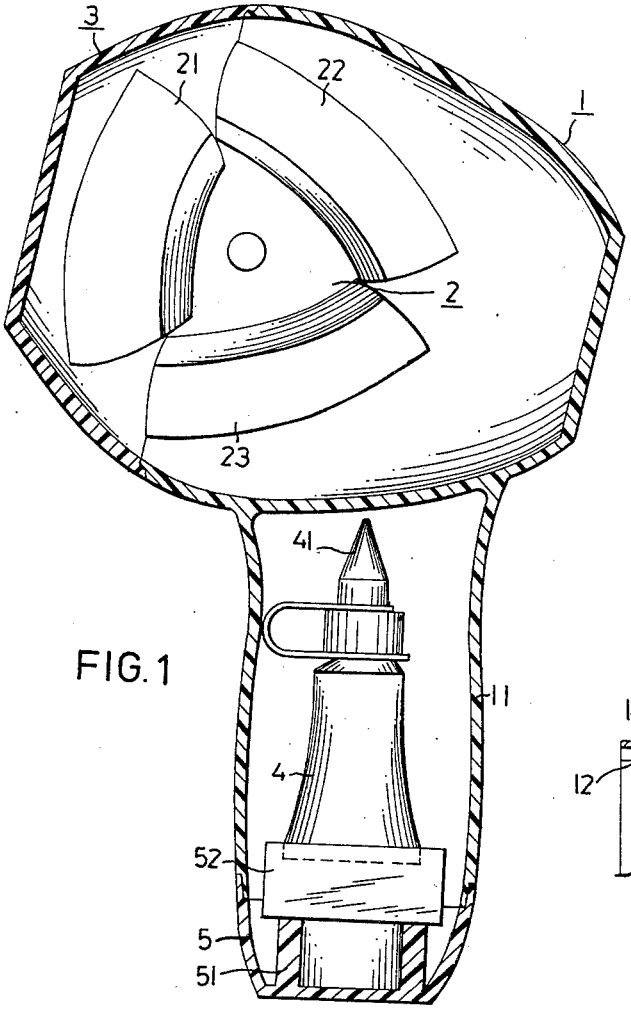
FIG. 1 depicts a cross-sectional view of the casing, roller set and the compartment to house the shoe cream container.
Figure 17:
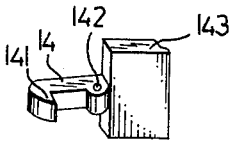
FIG. 17 depicts a perspective view of a snap locking device.
Figure 16:
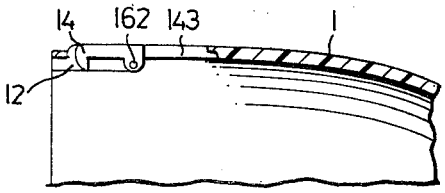
FIG. 16 depicts a top cross section view taken on line 50—50 of FIG. 15.

As shown in FIG. 1, a preferred embodiment of a shoe shine apparatus provides a casing 1 which houses a roller set 2. On the roller set, there is a brush 21 which is preferably made of bristle, a shoe cream spreader 22 which is preferably made of sponge and a buffer 23 which is preferably made of felt with a sponge padding filled inside. A cover 3 is provided to keep the outside environment from being tainted by the roller set and for easy of storage of the whole unit.

The handle 11 is an integrated portion of the casing 1. Inside of said handle 11 is provided a compartment for housing the shoe cream container 4. The said shoe cream container 4 is preferably made of collapsible tube and with a snap opening cap 41 for simple operation. Handle cap 5 provides a holding support for the shoe cream container and also serves as a cover for the handle 11 which will be detailed later.

The Roller Set

Figure 2:
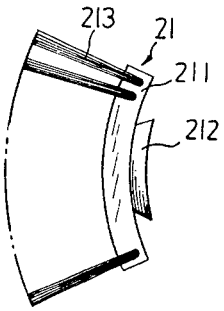
FIG. 2 depicts a side elevational view of a brush; .
Figure 3:
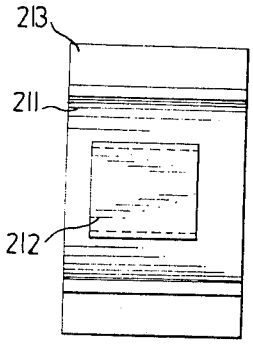
FIG. 3 depicts a bottom elevational view of a brush.
Figure 4:
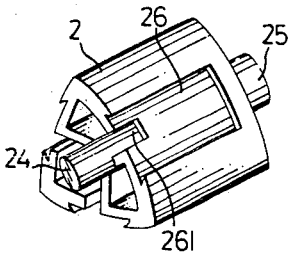
FIG. 4 depicts a front perspective view of a roller set base.
Figure 6:
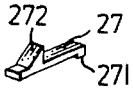
FIG. 6 depicts a perspective view of a brush locking piece.
Figure 13:
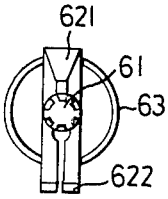
FIG. 13 depicts a bottom elevational view of a positioning knob.

As shown in FIG. 2 and 3, a brush 21 is made of a base 211, bristle 213 and a key lug 212 underneath. There is a corresponding key way 26 on the roller set base 2 (as shown in FIG. 4, 5) to enable the said key lug 212 to mesh and slide inwardly on the roller set base 2. A locking piece 27 (FIG. 6) has one end 271 to be fixed within the roller set base 2 and with its stud end 272 positioning at the key way opening 261; thus when the brush 21 is inside of the key way 26, the locking piece 27 will prevent it from sliding out of the roller set base. When the brush 21 has been worn out and a replacement is needed, depressing the free stud end 272 of the locking piece 27, the worn out brush can be moved out of the roller set base 2 and a new brush can be slided in on the roller set base. There are three key ways on the roller set base to hold the brush 21, shoe cream spreader 22 and buffer 23 respectively. And each one is 120° apart from each other. The foregoing replacement method is also applicable to the shoe cream spreader 22 and buffer 23.

Figure 5:
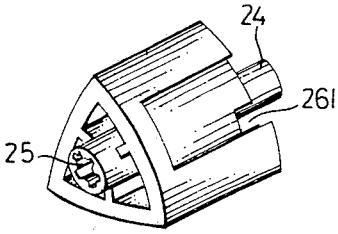
FIG. 5 depicts a rear perspective view of a roller set base.
Figure 8:
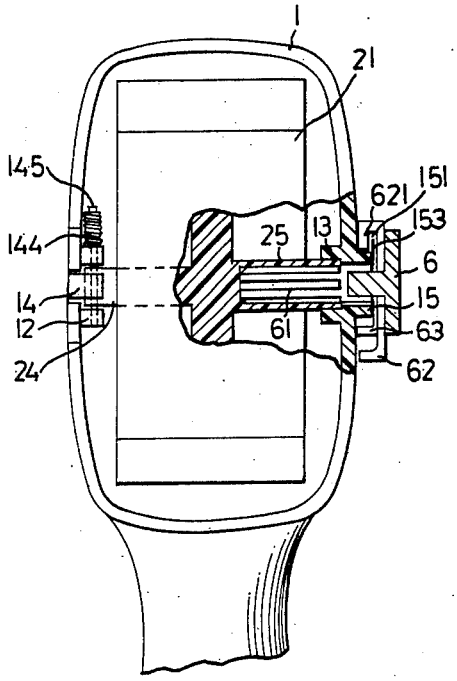
FIG. 8 depicts a front elevational view of the casing and roller set, partially in cross section taken on line 20—20 of FIG. 7.
Figure 9:
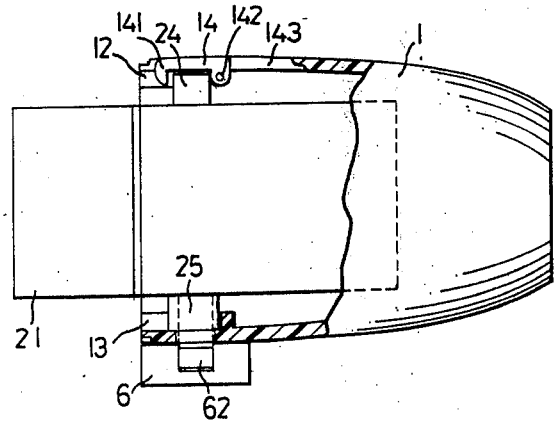
FIG. 9 depicts a top elevational view of the casing and roller set, partially in cross section taken on line 30—30 of FIG. 7.

As also shown in FIG. 4 and 5, the roller set has a shaft 24 extending on on side, and has another shaft 25 extending on the other side. The shafts 24 and 25 enable the roller set to rest on the casing 1 (as shown in FIG. 8, 9). There is an internal spline within the shaft 25 for roller set positioning function which will be described in the following.

Roller Set Positioning Device

Figure 7:
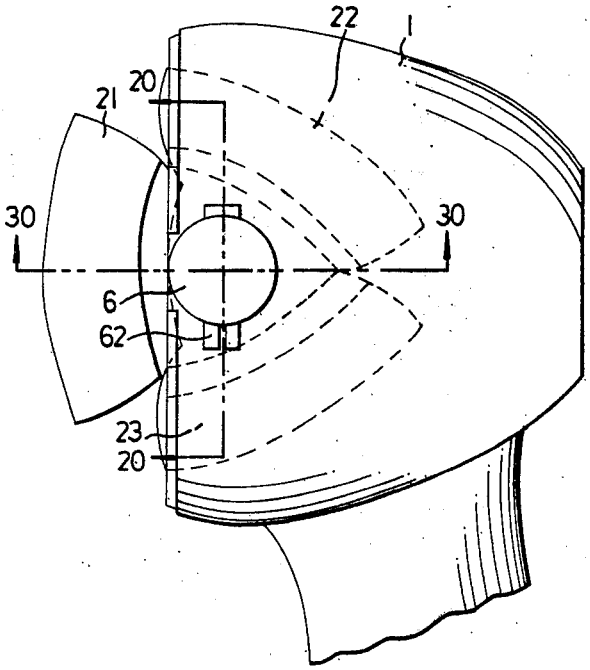
FIG. 7 depicts a side elevational view of the casing and roller set with the cover being removed.

When the brush 21 is to be used to remove the dirt from the shoe surface, it should be placed at the front position of the casing 1 as depicted in FIG. 7. This can be achieved through the roller set positioning device as shown in FIG. 7, 8, 9. On the casing 1 there is a circular opening 152 (FIG. 10, 11) to receive a spline shaft 61 which is attached to a positioning knob 6 at one of its ends. The spline shaft 61 is matched with the internal spline of the roller set shaft 25. Therefore by turning the positioning knob 6, the whole roller set can be turned accordingly. Thus either one of the brush 21, or shoe cream spreader 22 or buffer 23 can be turned and placed at the front position of the casing 1 respectively whenever needed.

During utilization, there is outside force applied to the roller set through the brush or shoe cream spreader or buffer. The roller set has to absorb the force and remain stationary. This can also be achieved by means of the roller set positioning device.

Figure 12A:
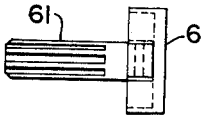
FIG. 12A is a side view of the positioning knob without the arm 62.
Figure 12:
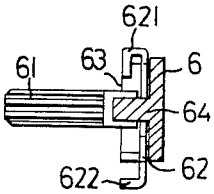
FIG. 12 depicts a side cross section view of a positioning knob.
Figure 14:
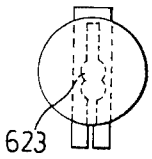
FIG. 14 depicts a top elevational view of a positioning knob.
Figure 10:
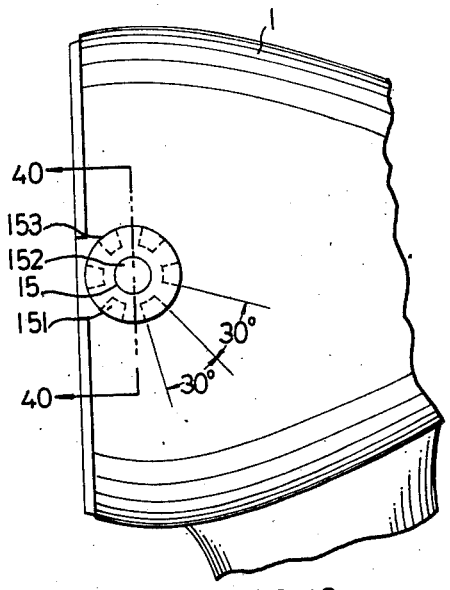
FIG. 10 depicts a side elevational view of the casing, with the positioning knob removed.
Figure 19:
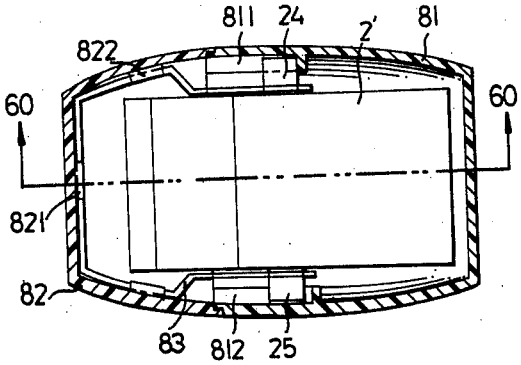
FIG. 19 depicts a top elevational view of the roller set cartridge with the cross section view of the casing.

As shown in FIG. 10, 11, there is a circular knob seat 15 outside of the casing 1. And around the knob seat 15 there are a plurality of locking concavities 151 which are preferably six in number and disposed 30° apart with each other. On the position knob 6, there is holding arm 62 (as shown in FIG. 12, 13, 14). The holding arm 62 is kept in position within the knob by the spline shaft 61 and circular knob flange 63, but can be moved to slide one way or another when there is pressure apply to either end 621 or 622. The end 621 is a locking stud which can be meshed with the locking concavity 151.

At locking position (as shown in FIG. 8), the spline shaft 61 meshed with the internal spline of the roller set shaft 25; the spline shaft 61 also has one end firmly fixed with the positioning knob 6, and the holding arm 62 has its locking stud 621 meshed with the locking concavity 151.

The outside force applied to the roller set during usage is transmitted through roller set shaft 25, spline shaft 61, positioning knob 6, circular knob flange 63, locking stud 621 and is finally absorbed by the locking concavity 151 and the knob seat 15 which is an integrated portion of the casing 1. Therefore the whole roller set can be held stationary when it is used.

Figure 11:
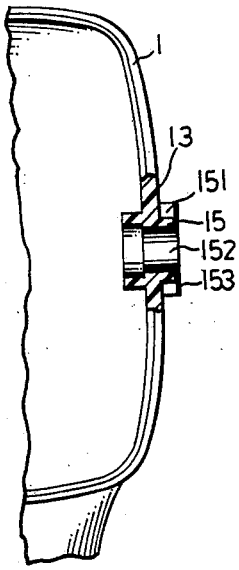
FIG. 11 depicts a half front elevational view of the casing, with the positioning knob removed, partially in cross section taken on line 40—40 of FIG. 10.

As shown in FIGS. 8 and 11 there is a circular metal cap 153 covering the knob seat 15, so that the locking stud 621 will remain at the locking concavity 151 and not loosen away during usage.

When it is required to turn the roller set to place either the shoe cream spreader or buffer at the front position, pressing the end 622 of the holding arm 62 will free locking stud 621 from the locking concavity 151, consequently the positioning knob 6 can be turned, while the spline shaft 61 is still meshed with the roller set shaft 25, the roller set can be turned accordingly.

As shown in FIG. 12, 14, the slotted and resilient holding arm 62 has an internal groove 623 which receives the knob shaft 64. The said groove 623 has been shaped to perform a switch function. Therefore the holding arm 62 can normally be moved to slide under pressure from either of its ends, and will remain stationary when the outside pressure is absent.

Roller Set Snap Locking Device

Figure 15A:
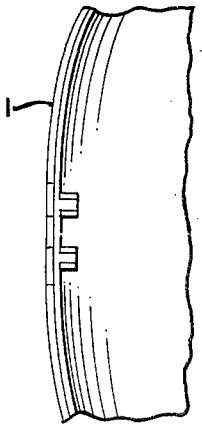
FIG. 15A depicts a broken away end view of the wall of the casing.
Figure 15:
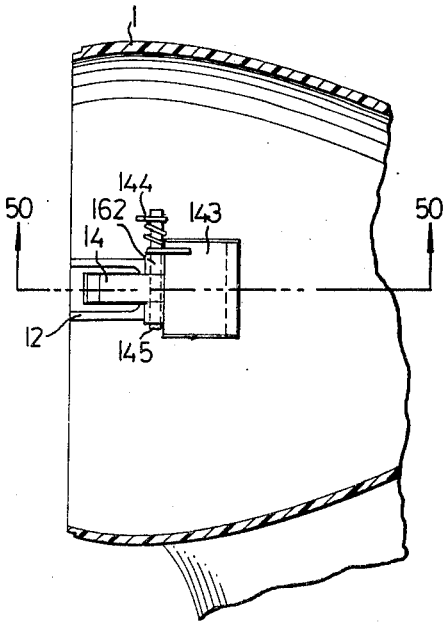
FIG. 15 depicts an other side elevational view of a casing.

As shown in FIG. 15, 16, on the other side wall of the casing 1, there is an opening to accommodate the roller set snap locking arm 14 having a hook 141 at one end and a snap flange 143 at other end. The snap locking arm 14 is hinged on the casing 1 by a pin 145 which passes through the center hole 142 on the locking arm and hole 162 provided on the casing wall (as shown in FIG. 8, 9). A pressed spring 144 will push the snap locking arm 14 in locking position.

When a roller set 2 is inserted into the casing 1, the roller set shaft 24 slides on the shaft guide 12 (while the other end of shaft 25 slides on the shaft guide 13, as shown in FIG. 8, 9), and will press the snap locking arm 14 to open to keep the shaft 24 in position (while the other end 25 will be kept in position by means of inserting the spline shaft 61 into the internal spline of the shaft 25).

On pulling the positioning knob 6 outward to disengage the spline shaft 61 from the roller set shaft 25, and to depress the snap locking arm flange 143, both ends of the roller set shafts 24 and 25 will be freed from the casing 1, thus the roller set 2 can be moved out of the casing for replacement of another roller set for applying different color of shoe cream.

Roller Set Cartridge

As there are always more than one color of shoes to be cleaned and polished, the replaceable roller set will enable one unit of shoe shine apparatus to meet this requirement. A roller set cartridge is provided to store the spare roller set, and also to make the changing and replacement of the roller set more easily and neatly.

Figure 18:
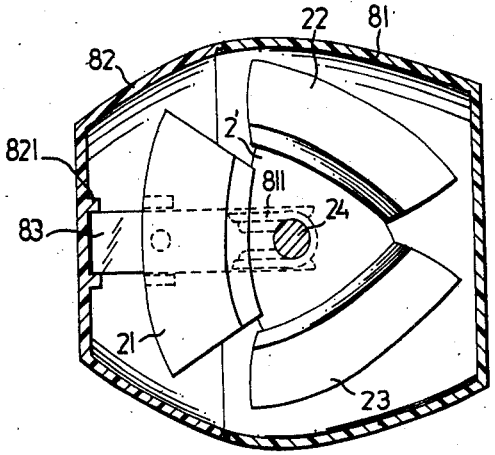
FIG. 18 depicts a side elevational view of a roller set cartridge with the cross section view of the casing.

As shown in FIG. 18, 19, the roller set cartridge consists of a receiving casing 81 and an inserting casing 82. The receiving casing 81 has shaft seats 811 and 812 on its sides, and can house a roller set which has been released from the casing 1.

Figure 21:
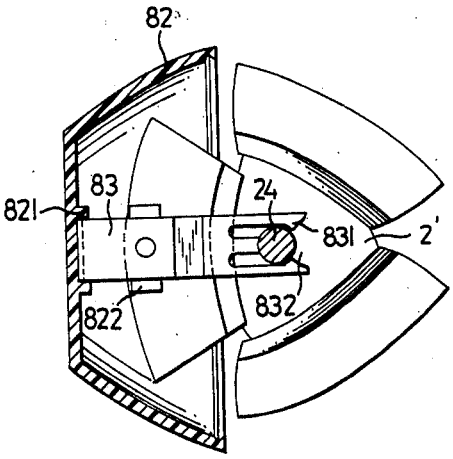
FIG. 21 depicts a cross-sectional view of the inserting casing of the roller set cartridge taken on line 60—60 of FIG. 19.
Figure 20:
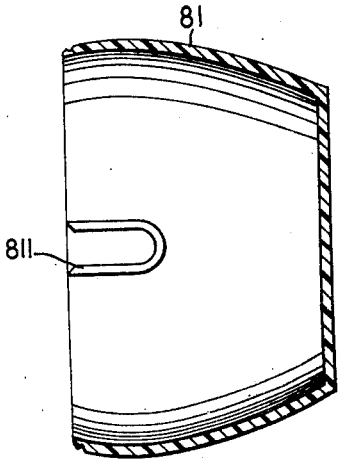
FIG. 20 depicts a cross sectional view of the receiving casing of the roller set cartridge taken on line 60—60 of FIG. 19.

As shown in FIG. 21, the replacing roller set 2' is held in the holding arms 83 of the inserting casing 82. The holding arms 83 being fixed to the inside walls of the inserting casing 82 through fixing means 821, 822. At the end of each holding arm 83, there is a slot opening 832 to enable the roller set shaft 24 (or 25) to pass through.

A small stud 831 is provided at each side of the opening 832 to the holding arm 83. The stud 831 will enable the roller set 2' to be held and retained on the holding arm 83; but also can allow the roller set 2' to be pulled out and free from the inserting casing when bigger force is applied to it.

The empty inserting casing 82 will serve as a cover of the receiving casing 81. When there is another roller set in the receiving casing 81, the empty holding arm 83 will grip the roller set 2' by the shaft 24 and 25, and make it ready for replacement purposes.

Shoe Cream Container and Compartment

As shown in FIG. 1, the handle 11 forms a compartment to house the shoe cream container 4. The shoe cream container 4 is preferably made of a collapsable tube and with a snap opening cap 41 for simple usage.

The shoe cream container 4 is gripped and held by a clip 52 which is attached to the support 51 of the handle cap 5.

I claim:

1. Portable shoe shine apparatus comprising a casing having a front opening and a roller set having a base provided with a shaft and slidably mounted on the peripheral surface of said base, a brush, a shoe cream spreader and a buffer disposed 120° apart from each other, the said base having on one end of its shaft an internal spline to receive a splined positioning knob provided in a seat at one side wall of the casing for turning the shaft to set any one of the brush, the shoe cream spreader, or the buffer to project through the front opening, the said positioning knob carrying a slidable holding arm with a locking stud to lock into a plurality of locking cavities disposed about the knob seat to hold the roller set in locked position; the other end of the roller shaft being seated on another side wall of the casing and locked in place by a snap locking arm hinged thereon, the roller set being inserted and confined in the casing through guides provided on the side walls of the casing for the shaft ends and being removable therefrom for replacement with a spare set; a handle integral with the casing and having a compartment to house a tube of cream which is gripped and held by a clip attached on a handle cap for closing the compartment.

2. Portable shoe shine apparatus according to claim 1, wherein a key lug is provided on the backing of each of the brush, cream spreader, and buffer to enable them to be slid into three key ways disposed 120° apart on the roller base to facilitate the easy replacement thereof.

3. Portable shoe shine apparatus according to claim 1, wherein the splined knob shaft projects through said seat, which seat includes a circular opening disposed on one side wall of the said casing to match with the internal splined end of the roller shaft to enable the turning of the roller and placing either the brush, or the cream spreader or the buffer at the front opening for use, and the circular knob seat is provided outside the casing wall with said plurality of locking cavities which are six in number and disposed 30° apart with each other.

4. Portable shoe shine apparatus according to claim 1, wherein the snap locking arm has a hook, the arm being hinged on the said another side of wall to retain the roller set, the said arm being depressable to release the said roller set from said casing for roller set replacement.

5. Portable shoe shine apparatus according to claim 1, wherein a separate roller set cartridge having a receiving casing and an inserting casing is provided, the receiving casing having shaft seats on both sides serving to house a spare roller set, the inserting casing having fixed in both inside walls holding arms with slot openings to grip the roller shaft ends during change of a roller set, the empty inserting casing also serving as a cover for the receiving casing.

* * * * *